US005339468A

United States Patent [19]

Lin

[11] Patent Number: 5,339,468

[45] Date of Patent: Aug. 23, 1994

[54] HOPPER LID AND THE FLUSH MECHANISM OF A FLUSH TOILET

[76] Inventor: Shyh S. Lin, No. 676, Sec. 2, Chang Ts'ao Rd., Homei Town, Changhua Hsien, Taiwan

[21] Appl. No.: 101,409

[22] Filed: Aug. 3, 1993

[51] Int. Cl.[5] ..... A47K 13/10; E03D 5/08

[52] U.S. Cl. ..... 4/246.5; 4/249

[58] Field of Search ..... 4/246.1, 246.3, 246.4, 4/246.5, 249, 250

[56] References Cited

U.S. PATENT DOCUMENTS

| | | | |
|---|---|---|---|
| 1,585,557 | 5/1926 | Miller | 4/249 |
| 5,056,165 | 10/1991 | Wescott, Sr. | 4/246.4 X |
| 5,103,506 | 4/1992 | Munford et al. | 4/246.4 |

*Primary Examiner*—Robert M. Fetsuga
*Attorney, Agent, or Firm*—W. Wayne Liauh

[57] ABSTRACT

An improved hopper seat/lid and flush mechanism for a flush toilet includes a control box having a seat/lid pedal and flush pedal mounted thereto. The seat/lid pedal is connected to the seat of the toilet through a linkage including a sliding rod. The flush pedal is connected to the flush handle of the toilet through a linkage including a straight pipe and spring. Actuation of the seat/lid pedal will move the toilet seat and lid from the closed to open position, or from the open to closed position depending on the orientation before actuation. Acutation of the flush pedal will cause the toilet to be flushed.

1 Claim, 7 Drawing Sheets

HOPPER LID AND THE FLUSH MECHANISM OF A FLUSH TOILET

BACKGROUND OF THE INVENTION:

A conventional seat type of flush toilet as shown in: FIG. 1 comprises a water tank "A", a hopper lid "B", a toilet seat "C" and a hopper "D"; the water tank "A" has a flush handle "E" for controlling the water in the tank to flush into the hopper "D" so s to flush away the waste in the hopper; however, the toilet seat "C" of such conventional flush toilet has to be lifted up and laid down manually and repeatedly during use. The user of such flush toilet would: feel inconvenient to use the same, and further, since a user's hand has to touch such toilet seat upon using, a sanitary consideration will be involved; moreover, when a user's hand presses the flush handle "E", a sanitary consideration can also be involved; in other words, such conventional flush toilet has the drawbacks of sanitation and operation.

SUMMARY OF THE INVENTION

This invention relates to an improvement for the hopper seat/lid pedal and the flush mechanism of a flush toilet, comprises seat control box mounted with a flush pedal and a hopper seat/lid pedal. When the flush pedal is stepped down, the flush handle seat will be actuated to start a flush; When the hopper seat/lid pedal is stepped down, the toilet seat will be lifted up or laid down so as to have the flush toilet operated in a sanitary and convenient condition.

FIG .2 is a perspective view of an embodiment according to the present invention.

Figure 3:
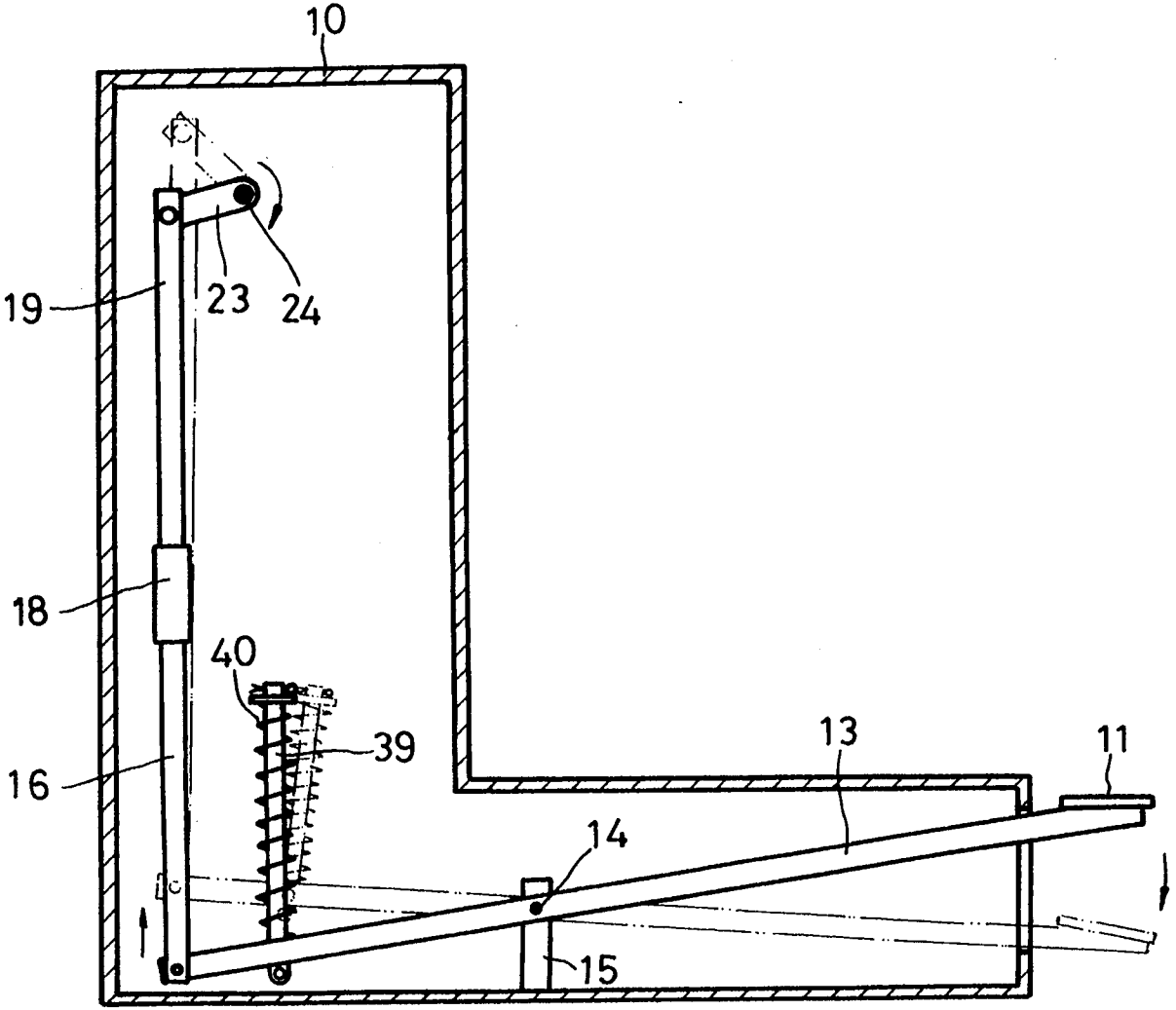

FIG. 3 is a sectional view of the flush-actuating mechanism according to the present invention.

Figure 4:
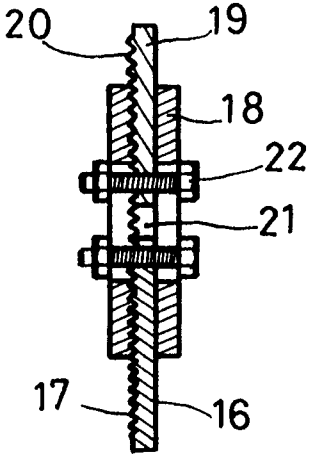

FIG. 4 is a sectional view of a connecting sleeve structure for the extension of an upper and lower rods according to the of the hopper seat/lid pedal lifting mechanism according to the present invention.

Figure 5:
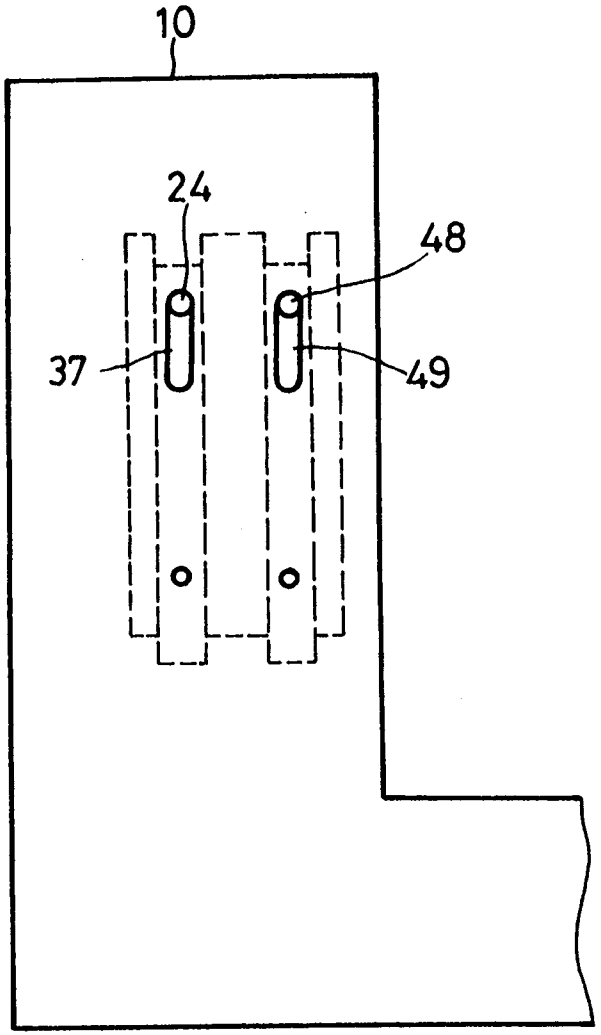

FIG. 5 is a fragmental side view of the control box according to the present invention.

Figure 6:
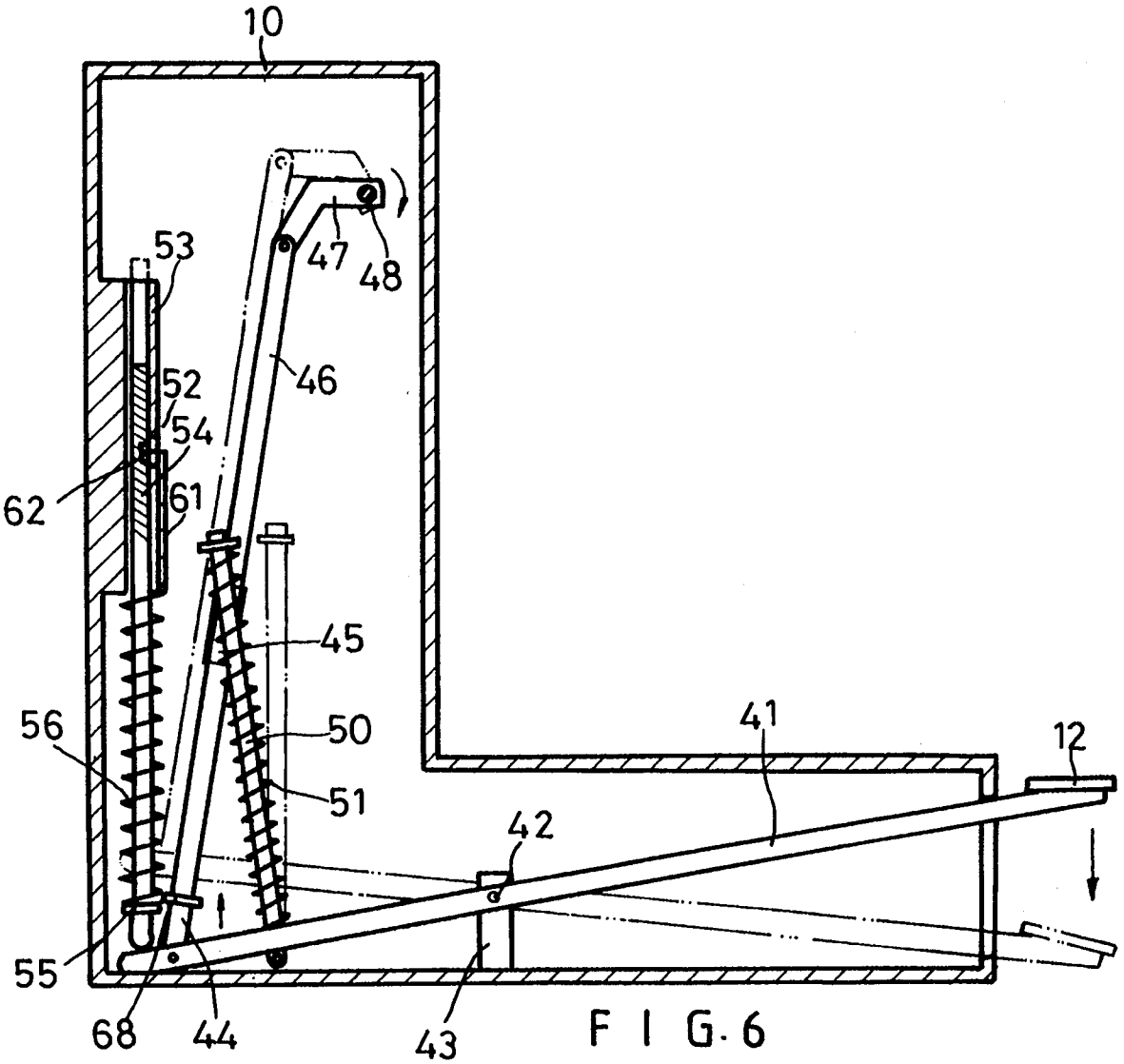

FIG. 6 is a sectional view of the hopper seat/lid pedal lifting mechanism according to the present invention.

Figure 7:
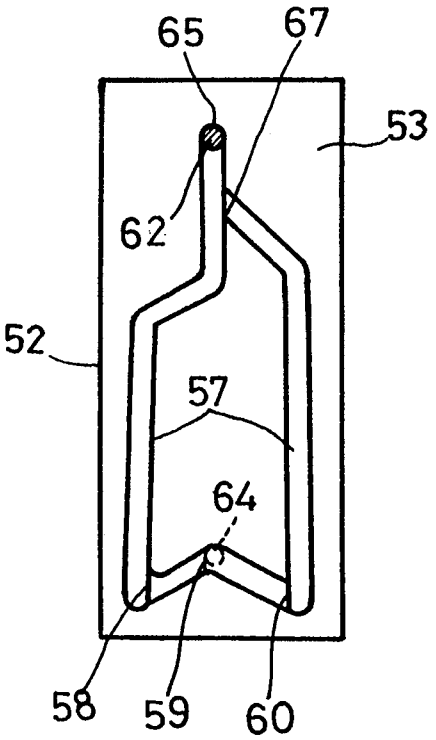

FIG. 7 is a plan view of a switch structure of the hopper seat/lid pedal lifting mechanism according to the present invention.

Figure 8:
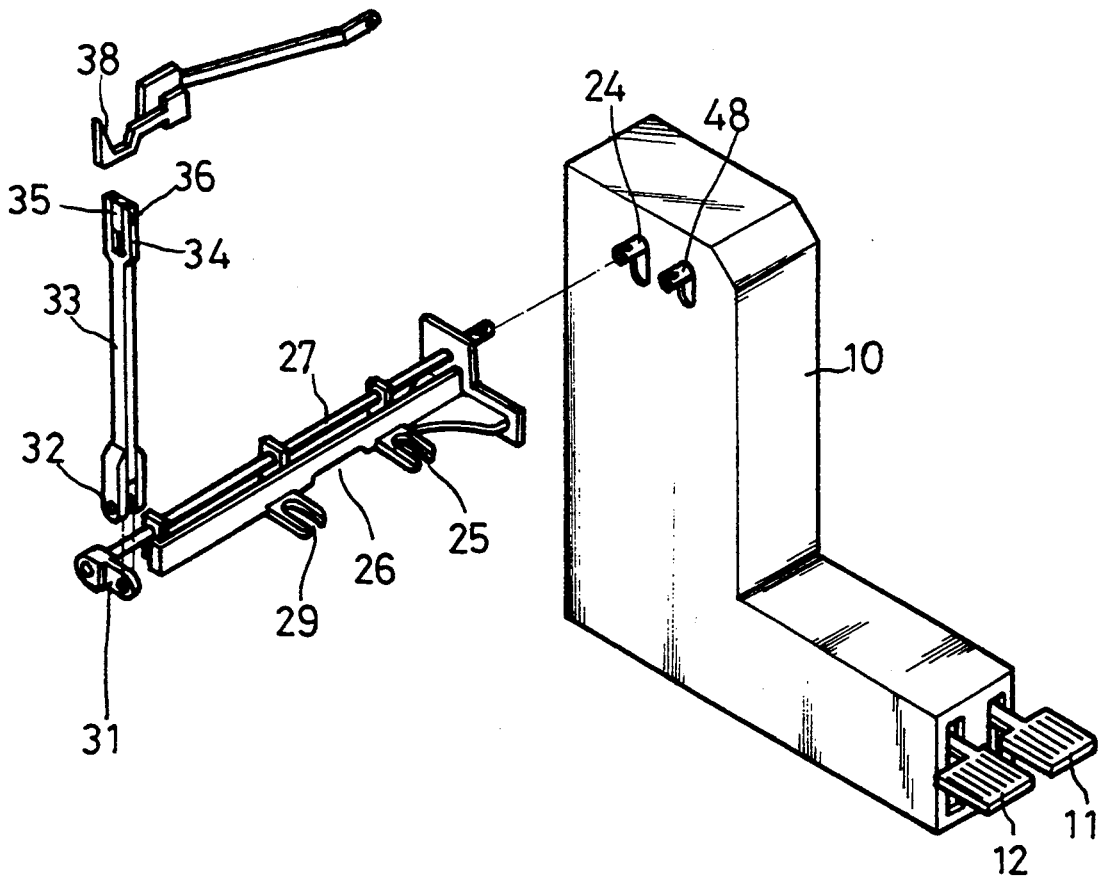

FIG. 8 is a disassembled view of the present invention.

Figure 9:
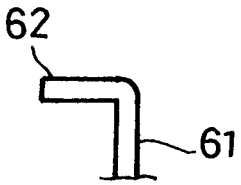

FIG. 9 is a side view of a positioning rod in the switch structure of the present invention.

Figure 10:
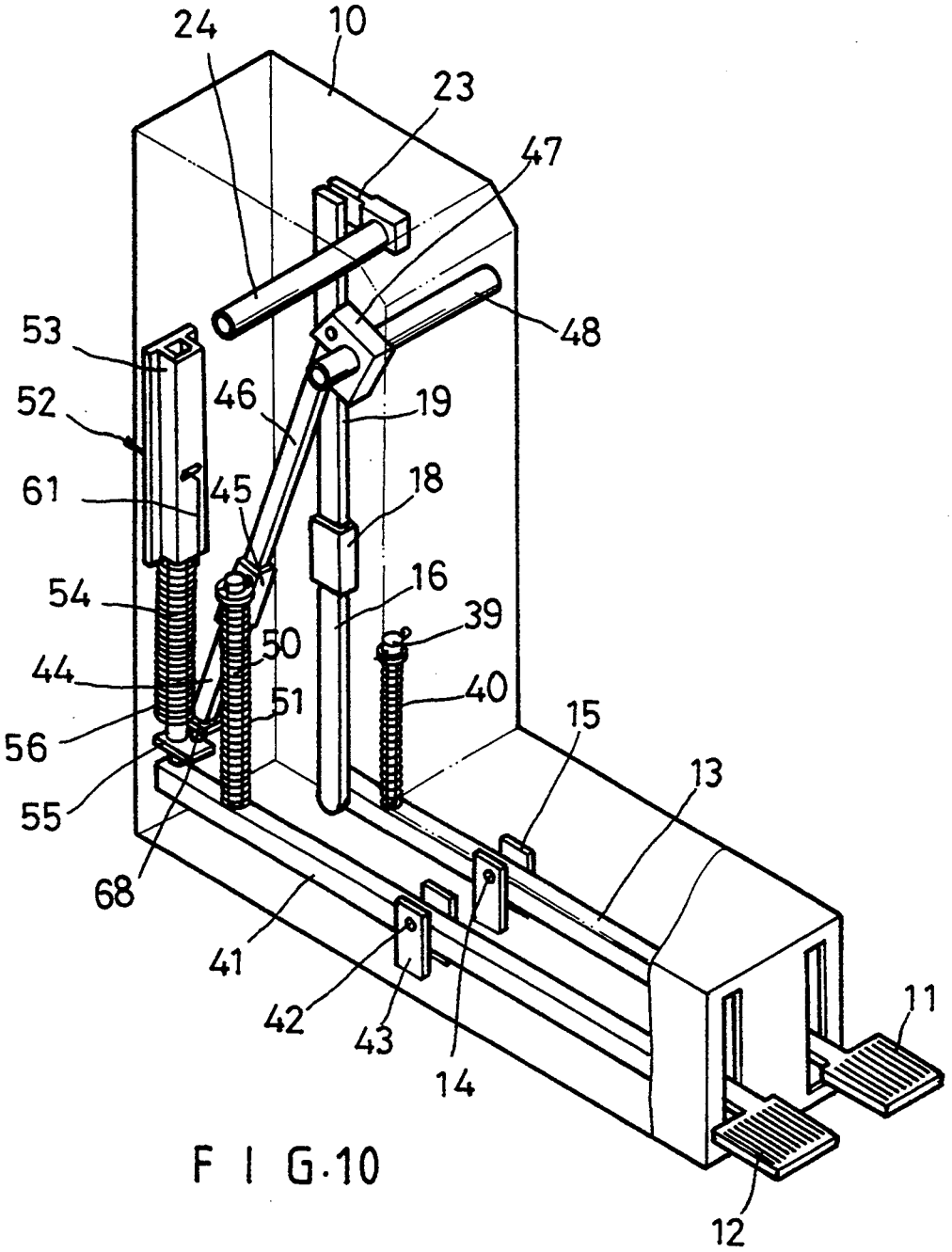

FIG. 10 is a perspective view of the inner parts of the control box of the present invention.

DETAILED DESCRIPTION

Figure 1:
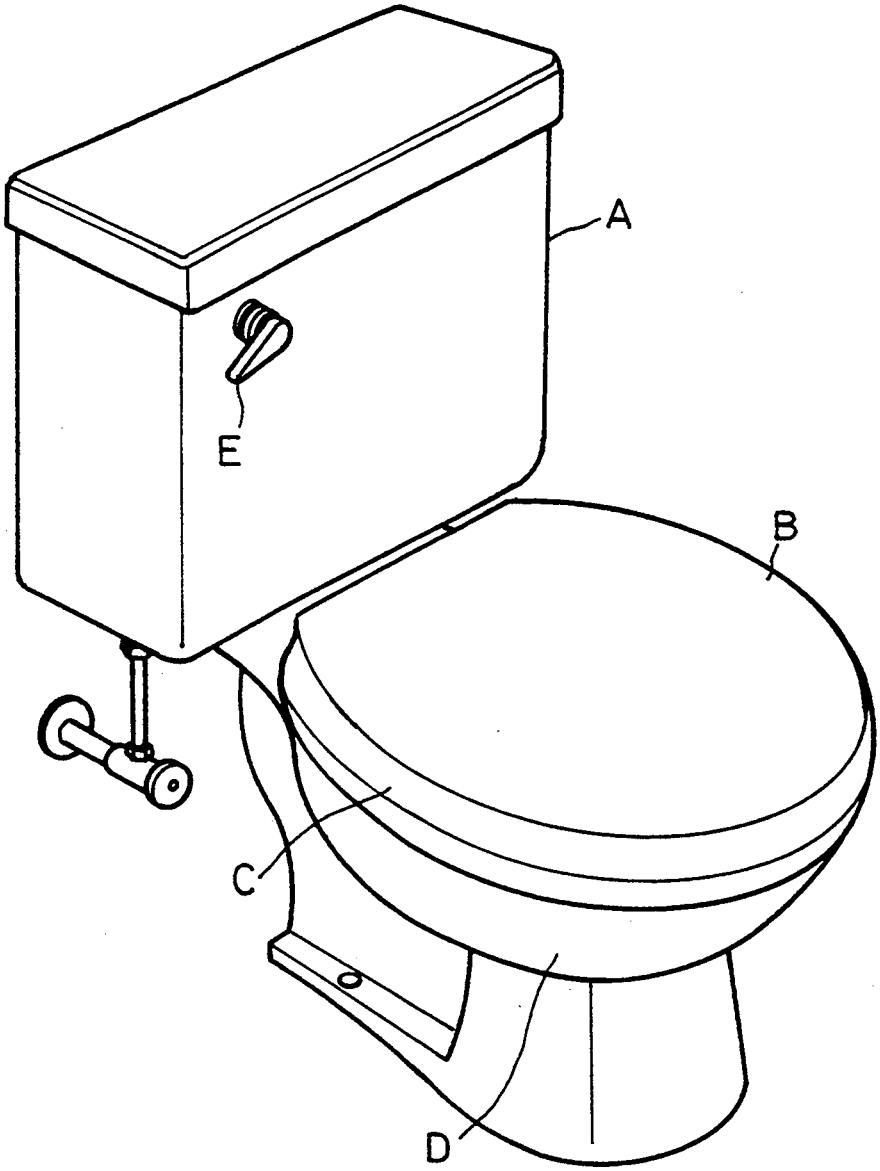
FIG. 1 is a perspective view of a conventional flush toilet.
Figure 2:
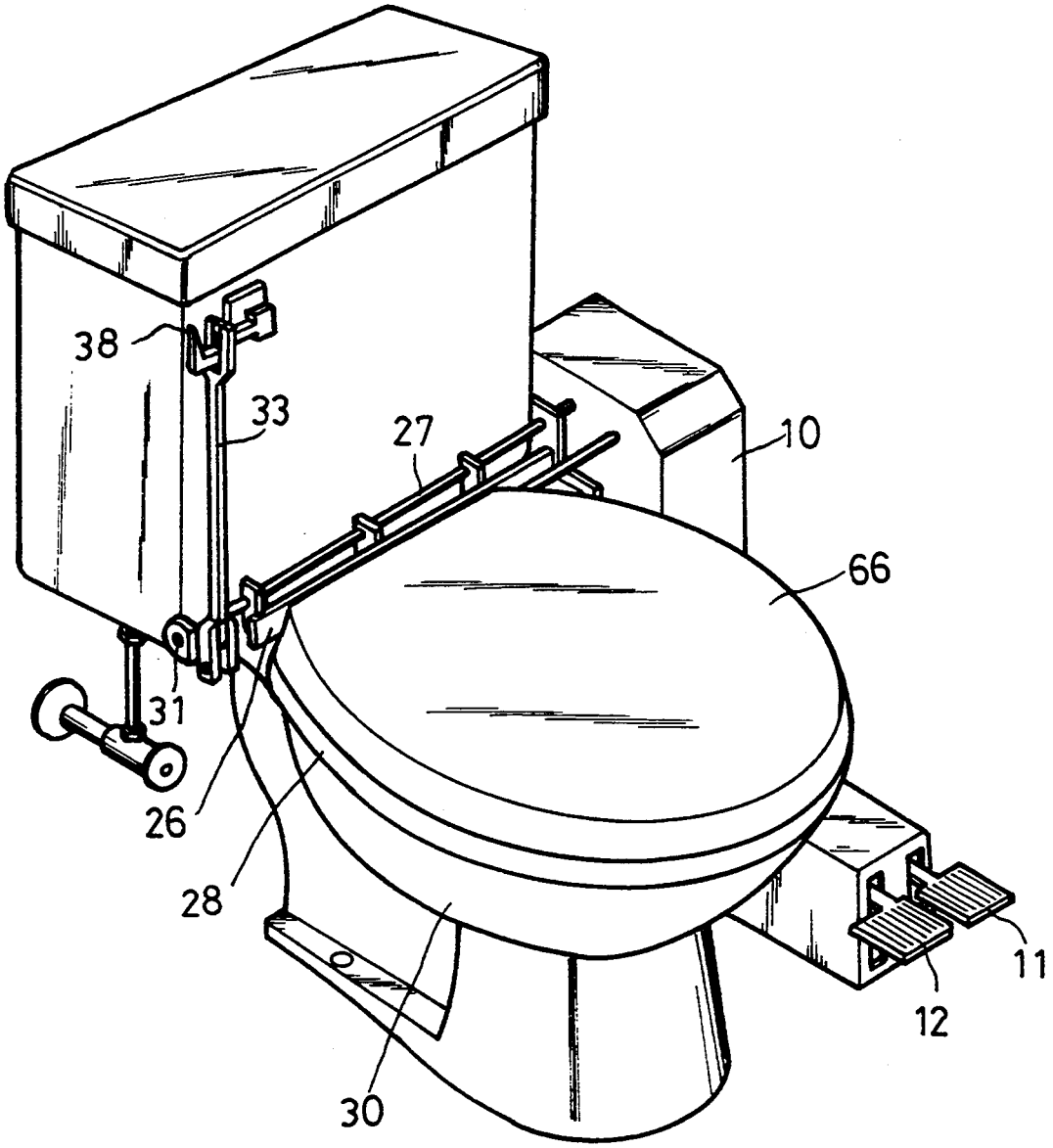

Referring to FIG. 2, the present invention comprises a L-shaped control box 10, of which the lower front end is mounted with a flush pedal 11 and a hopper seat/lid pedal 12. The flush pedal is fastened to a horizontal rod 13 (as shown in FIG. 3); the mid-part of the horizontal rod 13 is mounted on pivot 14 as a fulcrum; the pivot 14 is fixedly mounted on a supporting post 15. The rear end of the horizontal rod 13 is coupled with a vertical lower rod 16, of which the top is furnished with a tooth side 17 (as shown in FIG. 4). The lower rod 16 is connected with an upper rod 19 by means of a connecting sleeve 18. The upper rod 19 also has a tooth side 20. Both tooth sides 17 and 20 are engaged with a tooth side 21 of the connecting sleeve 18. By means of the aforesaid tooth sides 17, 20 and 21, the lower and upper rods 16 and 19 can be adjusted for a given extension of length without being slippery. The variable length of the rods 16 and 19 can meet the requirement of various hoppers; the two rods 16 and 19 can be fixed in place with screws. The upper end of the upper rod 19 is connected with a link rod 23 with a pivot 24, of which both ends are fixedly mounted in the upper part of the control box 10. The pivot 24 and the link rod 23 are fixed together with a screw (not shown). The pivot 24 can move up and down along two sliding slots 37 on both side of the control box 10 (as shown in FIG. 5) so as to facilitate the height adjustment thereof. The pivot 24 on the left side of the control box 10 is connected with a transmission shaft 27 on a fixed seat 26. The fixed seat 26 is mounted on the upper rear side of the hopper 30 by using a screw bolt (not shown) on the rear edge of the toilet seat 28 through the U-slots 29 and 25. The left end of the transmission shaft 27 is fastened with a coupling arm 31, which is pivotally connected with a coupling rod 33 through a pivot 32. The upper end of the coupling rod 33 has a U-shaped connecting fork 34, in which a sliding block 35 is mounted to move up and down, or to be fixed in place with a screw 36 after being adjusted. The control box 10 is mounted on the floor at the right side of the flush toilet, and is fastened to the upper rear side of the hopper 30 by using the fixed seat 26. The connecting fork 34 can be adjusted with the sliding block 35 to fit the height of the flush handle 38.

when the flush pedal 11 is pressed down, the horizontal rod 13 will be supported with the pivot 14 to push the upper and lower rods 19 upwards to cause the pivot 24 and the transmission shaft 27 to rotate through a link rod 23. The transmission shaft 27 will drive a coupling arm 31 to move downwards for pulling a coupling rod 33 and a connecting fork 34 which is fastened with a flush handle 38 to complete a flush function. In front of the connecting point between the rear end of the horizontal rod 13 and the lower rod 16, there is a straight pipe 39 being mounted with a spring 40; the lower end of the spring 40 is in contact with the horizontal rod 13. i.e., to provide a return force for the horizontal rod 13 so as to restore the flush pedal 11 to the lifted position.

The rear end of the hoppers seat/lid pedal 12 is connected with a horizontal rod 41 (as shown in FIG. 6), which is pivotally mounted on a pivot 42 as a fulcrum on a supporting post 43. The rear end of the horizontal rod 41 is connected with a lower push rod 44 which is connected, through a connecting sleeve 45, with an upper push rod 46; between the two rod 44 and 46 and the connecting sleeve 45, there are tooth sides being engaged each other for adjusting the length of the two push rods 44 and 46. The upper end of the upper push rod 46 is mounted with a connecting arm 47 and a shaft 48 which is mounted on both sides of the control box 10. The shaft 48 is fitted in a sliding slot 49 in an up-and-down manner so as to facilitate the length adjustment of the two push rods 46 and 44. The rear end of the horizontal rod 41 is mounted with a straight pipe 50 with a spring 51, which are used for returning the hopper seat/lid pedal to its normal position. On the rear end of the horizontal rod 41, there is a switch structure 52 (as shown in FIG. 7), which includes a sliding slot block 53 in the control box 10, a sliding rod 54 with a flat plate 55 fixed to the lower end of the sliding rod 54, and a spring 56 mounted above the flat plate 55 and around the sliding rod 54; the spring 56 is used for pushing the flat plate 55 and the sliding rod 54 to press the rear end of the horizontal rod 41 downwards. The flat plate 55 and a push plate 68 are engaged with each other to prevent the sliding rod 54 of the switch structure 52 from bouncing back. One side of the upper end of the sliding rod 54 has a control. sliding slot 57 with a stiff-and-slanting surface, which is furnished with a plurality of check points 58, 59, 60, and 67; such check points can have the rod end 62 of a positioning spring rod 61 slid in the control sliding slot 57 counter-clockwise only. When the hopper seat/lid pedal 12 is pressed down, the rear end of the horizontal rod 41 will push the upper and lower push rods 46 and 44 upwards; the connecting arm 47 will drive the shaft 48 to rotate. The shaft 48 is coupled with a square shaft (not shown) on the toilet seat 28. When the shaft 48 and the square pivot of the toilet seat 28 are rotated, the toilet seat 28 will be laid downwards. When the hopper seat/lid pedal 12 is pressed, the rear end of the horizontal rod 41 will also push the sliding rod 54 upwards; the rod end 62 of the positioning rod 61 will slide from the upper left side in the control sliding slot 57 downwards into the lower stop point 64 so as to have the toilet seat 28 fallen on the hopper 30 slowly. When a user leaves the toilet seat 28, he (or she) should step on the hopper seat/lid pedal 12 again to have the rod end 62 moved upwards in the right side of the control sliding slot 57 unit reaching the top stop point 65; simultaneously, the shaft 48 and the square shaft will cause the toilet seat 28 to be lifted up; in other words, the switch structure 52 is used for controlling the toilet seat 28 to lay down and to lift up. The flush pedal 11 and the hopper seat/lid pedal 12 are used for controlling the flush and the toilet seat to move up and down so as to provide a simple operation in a sanitary condition to a user; further, the present invention is deemed simple in assembling and disassembling operation.

I claim:

1. A hopper seat/lid and flush mechanism for a flush toilet characterized in that said hopper seat/lid and flush mechanism comprising:

a control box having lower front part, said lower front part having a flush pedal and a hopper seat/lid pedal; said flush pedal having a rear end connected with a horizontal rod, said horizontal rod being supported by a supporting post; said horizontal rod having a rear end which is connected with a vertical lower rod, said vertical lower rod being further connected with an upper rod through a connecting sleeve; said vertical lower rod and said upper rod having adjustable length thereof through said connecting sleeve;

said upper rod having an upper end connected with a link rod, said link rod having a front end fixedly connected with a pivot mounted on first and second sides of said control box; said pivot sliding up and down in two sliding slots on said first and second sides of said control box so as to facilitate adjustment of its height;

said control box having a left wall and said pivot having a portion thereof extended out of said left wall of said control box and connected with a transmission shaft mounted on a fixed seat; said hopper having upper rear side and said fixed seat adapted for being fastened with a screw bolt to said upper rear side of said hopper; said transmission shaft having a left end which is fastened with a coupling arm and connected with a lower end of a coupling rod; said coupling rod having an upper end, which has a connecting fork with a sliding block adapted to be connected to a flush handle and is capable of sliding up and down for adjusting the height of said flush pedal; whereby when said flush pedal is stepped down, said horizontal rod on said pivot will push said upper rod and said vertical lower rod upward to cause said link rod to rotate said pivot, and said pivot will drive said transmission shaft to pull said coupling rod and said connecting fork to start a flush;

said hopper seat/lid and flush mechanism further comprising a straight pipe with a spring which is mounted at said rear end of said horizontal rod near a connecting point between said horizontal rod and said vertical lower rod, said spring having a bottom end which is in contact with said horizontal rod so as to enable said horizontal rod and said flush pedal to return;

a rear end of said hopper seat/lid pedal being connected with a horizontal rod mounted on a pivot as a fulcrum; the rear end of said seat/lid horizontal rod being connected with a lower push rod which is connected with an upper push rod through a connecting sleeve; said upper push rod having an upper end which is connected with a connecting arm and a shaft, said shaft being mounted across two sliding slots on said first and second sides of said control box so as to provide an adjustable space for said upper and lower push rods; the rear end of said seat/lid horizontal rod being mounted with a straight pipe and a spring to enable said hopper seat/lid pedal to return; the rear end of said seat/lid horizontal rod also being mounted with a switch structure, which includes a sliding slot block fitted with a sliding rod, said sliding rod having a lower end fastened with a flat plate, and said seat/lid spring being mounted around said sliding rod so as to be able to cause said flat plate and said sliding rod to press said rear end of said seat/lid horizontal rod downward;

said flat plate having a top side which is engaged with a push plate mounted on said lower push rod; said sliding rod having an upper front side which has a control sliding slot with a stiff-and-slanting surface and a plurality of check points; said hopper seat/lid and flush mechanism further comprising a positioning rod having a rod end engaged with said control sliding slot and being able to slide counter-clockwise without returning; and when said hopper seat/lid pedal is pressed down, said rod end of said positioning rod being able to be positioned at a top point and a lower point;

whereby as soon as said hopper seat/lid pedal is pressed down, said horizontal rod will push said upper and lower push rods upward to cause said connecting arm and said shaft to rotate; said shaft adapted for being mounted with a square shaft behind the rear end of said toilet seat, and when said square shaft rotates, said toilet seat will be laid down; at the same time, when said hopper seat/lid pedal is pressed down said switch structure on the rear end of said horizontal rod will cause said toilet seat to fall slowly on said hopper.

* * * * *